United States Patent [19]

Browne

[11] Patent Number: 4,931,023

[45] Date of Patent: Jun. 5, 1990

[54] CORD STRAIN RELIEF DEVICE AND ASSOCIATED LAMP

[76] Inventor: Alan R. Browne, 4675 Oberlin Way, Marietta, Ga. 30068

[21] Appl. No.: 425,744

[22] Filed: Oct. 23, 1989

Related U.S. Application Data

[63] Continuation-in-part of Ser. No. 409,406, Sep. 19, 1989.

[51] Int. Cl.[5] ..... H01R 13/58

[52] U.S. Cl. ..... 439/459; 439/457

[58] Field of Search ..... 439/456, 457, 459, 460–462, 439/465, 469

[56] References Cited

U.S. PATENT DOCUMENTS 3,336,565 8/1967 Crimmins ..... 439/459

FOREIGN PATENT DOCUMENTS 2068176 8/1981 United Kingdom ..... 439/459

2069254 8/1981 United Kingdom ..... 439/459

OTHER PUBLICATIONS

Browne, Stewart R., "Maintenance and Care for Model XP65", (brochure).

*Primary Examiner*—Eugene F. Desmond

*Attorney, Agent, or Firm*—Kilpatrick & Cody

[57] ABSTRACT

An improved device for relieving stresses on electrical connections between external cables and load circuits is disclosed. A two-piece bushing holder clamps the cable in position rather than using friction fittings as in earlier designs. Alternating downward and upward protrusions force the cable to assume a serpentine shape having alternating peaks and valleys within the bushing holder, substantially preventing movement of the cable and breakage of its connection to the load. The device is well-suited for use with portable loads such as industrial work lamps, which loads are subjected to severe stresses, as use of the clamping mechanism increases the force required to dislodge the cable and open the electrical connection. The device also may be made watertight according to certain industry and government specifications and less likely to ignite any combustable gasses present, making it suitable for use in hazardous environments as well.

10 Claims, 1 Drawing Sheet

CORD STRAIN RELIEF DEVICE AND ASSOCIATED LAMP

CROSS-REFERENCE TO RELATED APPLICATION

This application is a continuation-in-part of design patent application Ser. No. 07/409,406 filed Sept. 19, 1989, entitled "Electrical Cord Strain Relief Structure," which application is incorporated herein in its entirety by this reference.

FIELD OF THE INVENTION

The present invention relates to devices for relieving tension on cables or cords and more particularly to devices for relieving stresses on electrical current-carrying cords at points where the cords connect to electrical loads.

BACKGROUND OF THE INVENTION

Insulated multi-wire cables may be used to conduct electricity from remote sources to electrical loads such as lamps and machines. These cables often terminate at points within the housings for the loads and have their wires connected, via solder, wire nuts, pin connectors, or otherwise, to circuitry within the load housings. The connections between the wires of a cable and internal load circuitry are relatively fragile; if sufficient tension is placed on the insulated cable the wires may separate from the internal circuitry at the connecting points and open the electrical path from the source to the load. Such failures not only disable the electrical appliance or device but often expose conductors, which may be dangerous, particularly in wet or explosive environments. These problems are compounded by the stresses placed on cables connecting sources to portable devices as the devices are moved from one location to another. In recognition of these dangers, Underwriters Laboratories, Inc. "UL") recently adopted a stricter strain relief test for portable electric lighting units intended for use in hazardous locations (UL Standard 781, as amended July 5, 1989).

Various devices have been designed to lessen the strain placed on cords or cables connecting sources to electrical loads. One simple apparatus for relieving tension on connection points between a cable and circuitry internal to a load is a grommet (or bushing) placed at the entry point of the cable into the load housing. Once threaded through the grommet the cable's movement is restricted by the grommet's small diameter opening, thereby preventing the cable section within the housing from moving freely in response to external forces. Because the cable is merely friction fitted into the grommet, however, some stresses encountered in normal operating environments for portable loads (particularly those comprising forces substantially coincident with the longitudinal axis of the grommet) continue to cause substantial movement of the cable and corresponding breakage of the electrical contacts between cable wires and internal load circuitry.

SUMMARY OF THE INVENTION

The present invention provides an improved device for relieving stresses on electrical connections between external cables and load circuits by resisting forces tending to pull the cables from the fixtures to which they are attached. The invention includes a two-piece bushing holder into which a cable is clamped rather than friction fitted as in earlier designs. The first portion of the bushing holder contains two cavities, separated by a wall, for receiving adjacent portions of the cable. The cable section intermediate the adjacent portions lies against the wall separating the cavities, forcing the cable to assume a convoluted or serpentine shape having alternating peaks and valleys within the bushing holder. The second bushing holder portion, having protrusions aligned with the cavities, may then be secured to the first portion, thereby effectively clamping the cable segment within the bushing holder. The device is well-suited for use with portable loads such as industrial work lamps, which loads are subjected to severe stresses, as use of the clamping mechanism increases the force required to dislodge the cable and open the electrical connection. If appropriate materials are chosen for components of the cord strain relief device, the device also may be used in connection with watertight and environmentally insulated lamps utilized in wet or combustable surroundings.

It is therefore an object of the present invention to provide an improved device for relieving stresses placed upon electrical connections involving external cables or cords.

It is an additional object of the present invention to provide a device for securing a cable within an object using a clamping mechanism.

It is another object of the present invention to provide a device useful as part of an electrical appliance such as a portable lamp utilized in a wet or combustible environment.

Other objects, features, and advantages of the present invention will become apparent with reference to the remainder of the written portion and the drawings of this application.

DETAILED DESCRIPTION OF THE DRAWINGS

Figures 1, 2, 3:
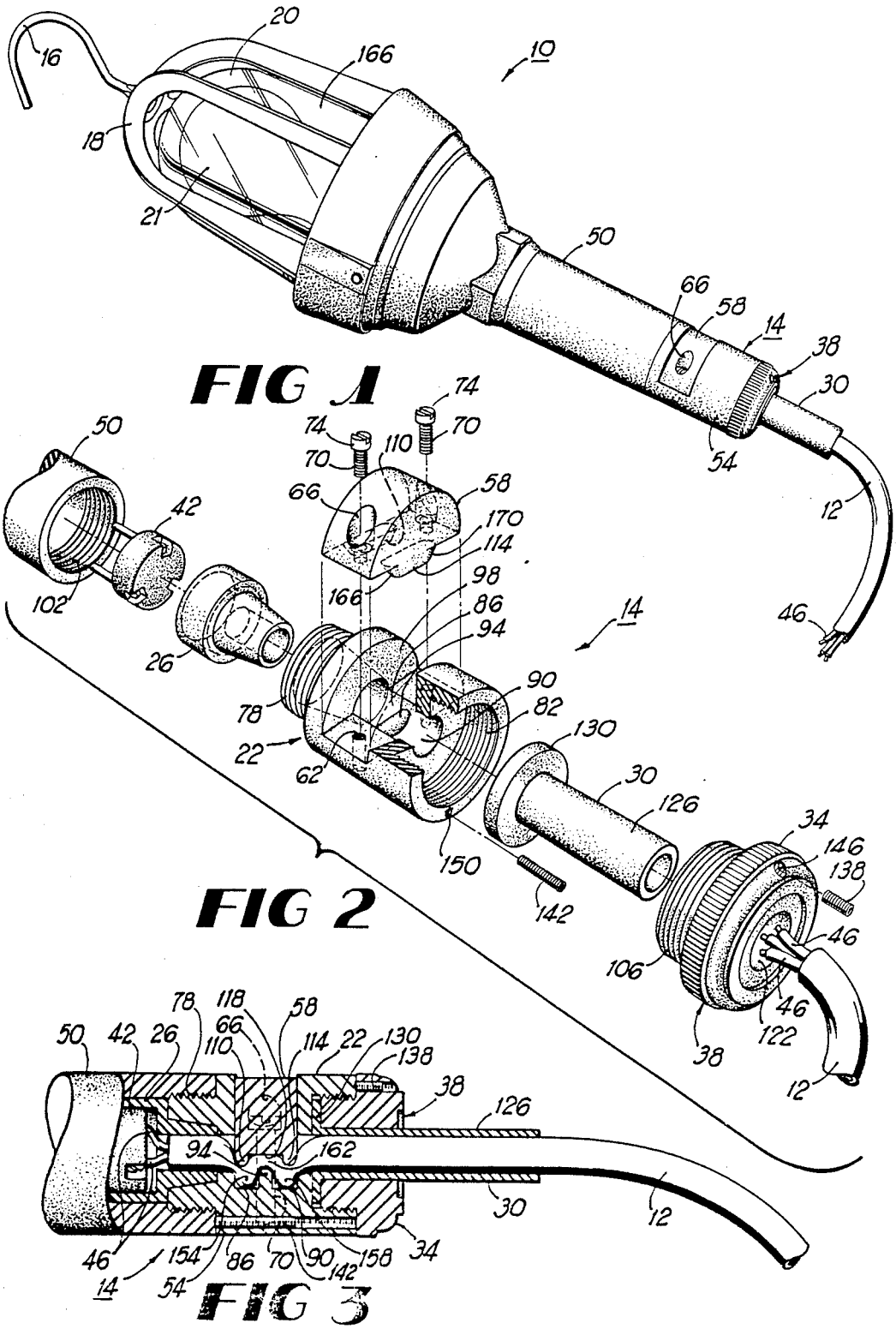
FIG. 1 is a perspective view of the cord strain relief device and associated lamp of the present invention shown connected to an electrical cord.
FIG. 2 is an exploded perspective view of the cord strain relief device of FIG. 1 with a portion cut away.
FIG. 3 is a cross-sectional view of the cord strain relief device in FIG. 1.

FIG. 1 details a portable lamp 10 of the type which may be connected to a remote power source through an insulated cord or cable 12 and the cord strain relief device 14 of the present invention. Lamp 10 contains a hook 16 to allow placement in a variety of locations and a guard 18, typically made of aluminum, surrounding a globe 20. Globe 20 shields the electrical load 21 (shown in FIG. 1 as a light bulb) from the environment of the lamp 10, decreasing the likelihood that breaking the light bulb serving as electrical load 21 would ignite any combustable gases present. Lamp 10 also may be made watertight according to various industry and government standards.

Referring to FIG. 2, cord strain relief device 14 includes cord bushing holder 22, front and rear cord bushings 26 and 30, respectively, and rear cap 34. Cord bushing holder 22 clamps cable 12 in position to inhibit movement of the cable 12 responsive to external forces. Rear cord bushing 30 protects cable 12 from excessive bending at the point 38 where the cable 12 enters cord strain relief device 18, while rear cap 34 secures rear cord bushing 26 to cord bushing holder 22. Also shown in FIG. 2 are load socket or base 42, to which the wires 46 of cable 12 may be connected, and load housing 50.

FIGS. 2–3 detail the cord bushing holder 22 of the present invention. Cord bushing holder 22 includes main assembly 54 and cover 58. Each of the main assembly 54 and cover 58 contain alignable openings 62 and 66, respectively, into which set screws 70 may be placed, both to secure cord bushing holder 22 when portable lamp 10 is in operation and to provide easy access to the internal structure of the cord bushing holder 22 if cable 12 need be removed. As shown in FIGS. 1–2, openings 66 in cover 58 may be recessed to prevent screw heads 74 from extending beyond the periphery of the cover 58. Those skilled in the art will recognize, however, that any appropriate removable fastening means may be used to secure main assembly 54 and cover 58.

Main assembly 54 additionally includes externally threaded nipple 78 at one end and internally threaded tube 82 at the other end, cavities 86 and 90 extending longitudinally throughout portions of the main assembly 54, wall 94 separating cavities 86 and 90, and semicircular opening 98 into which cover 58 may be fastened. Nipple 78 is received in internally threaded base 102 of load housing 50, and internally threaded tube 82 receives nipple 106 of rear cap 34. Cover 58 is generally shaped like a longitudinal section of a cylinder with tabs 110 and 114 (FIGS. 2–3) extending from its bottom 118, which tabs partially fill cavities 86 and 90, respectively, when main assembly 54 and cover 58 are fastened together.

Assembly of cord strain relief device 14 may be performed quickly and easily. Rear cap 34 contains an opening 122 at entry point 38 through which tubular portion 126 of rear cord bushing 30 extends. Because the flanged base 130 of rear cord bushing 30 has a diameter intermediate the diameters of nipple 106 and opening 122, the rear cord bushing 30 may be captured by the rear cap 34. Cable 12 subsequently is inserted through the rear cord bushing 30 and rear cap 34 into main assembly 54. From main assembly 54 cable 12 is passed through front cord bushing 26 (which fits within cord bushing holder 22 through nipple 78) to load socket 42, at which socket the cable wires 46 may be electrically connected to load 21, shown in FIG. 1 as a light bulb. Fastening means such as screws 138 and 142 may be used in connection with openings 146 and 150 to assemble the components of cord strain relief device 14 and secure the cord strain relief device 14 to load housing 50.

Once cable 12 is appropriately threaded through rear cord bushing 30, rear cap 34, main assembly 54, and front cord bushing 26, cover 58 is used to clamp cable 12 in position and secure it against external forces. Referring principally to FIG. 3, as cover 58 is fitted to main assembly 54 tabs 110 and 114 contact cable 12 and force segments 154 and 158 of the cable 12 respectively into cavities 86 and 90. Simultaneously bottom 118 contacts cable segment 162 and forces it against wall 94, causing cable 12 alternately to travel upward and downward within cord bushing holder 22 and producing a serpentine shape of alternating peaks and valleys for cable 12 when viewed in a cross-section taken along its longitudinal axis as shown in FIG. 3. The combination of alternating upward and downward protrusions formed by tab 110, wall 94, and tab 114 serve to clamp cable 12 in position within the device 14, relieving stresses which otherwise might affect the integrity of the electrical connection between wires 46 and load socket 42.

Paragraphs 27.1 and 27.3A of UL Standard 781 allow a cord or cable displacement of no more than 3/32 inch (2.4 mm) resulting from a direct pull of 90 pounds-force (400N) on the cord for one minute. In an embodiment of the invention designed to meet the UL standard and to secure three-conductor insulated #14 or #16 gauge cable, main assembly 54, cover 58, and rear cap 34 are made of Fiberite CFI-20 and front and rear cord bushings 26 and 30, respectively, are formed of neoprene rubber. The diameter of main assembly 54 is approximately one and five-eighths inches, while threaded opening 106 has diameter of one-half inch and opening 122 is one and one-quarter inches in diameter. Tabs 110 and 114 extend one-eighth inch below bottom 118 of cover 58 and have edges 166 and 170 which approach bottom 118 at 135° angles. In this embodiment the width of cover 58 and the corresponding semicircular opening 98 of main assembly 54 are approximately five-eighths inch. The embodiment may be fitted to be watertight in order to protect the internal electrical connections when the device 10 is used in a moist environment. If load 21 is a light bulb, a high impact glass globe 21 may be used to enclose the bulb and insulate it from the environment, decreasing the risk that the bulb's internal filament would ignite any combustable gases present should the bulb break.

None of these materials or dimensions is critical to the invention, however, and any or all may be altered as desired to accommodate different loads and cable sizes and types. Additional modifications, including the use of cable or other elongated objects designed for other than electrical purposes, will be apparent to those of ordinary skill in the art and may be made without departing from the scope or spirit of the invention.

What is claimed is:

1. A device for securing the position of an elongated object comprising:

a. a lower housing section defining first and second cavities for receiving portions of the object and comprising a first protrusion separating the first and second cavities, which first protrusion is positionable to contact the object at a first point;

b. an upper housing section fastenable to the lower housing section and comprising second and third protrusions, which second and third protrusions are alignable with the first and second cavities, respectively, and are positionable to contact the object at points remote from the first point along the length of the object;

c. a front bushing positionable at least partially within the lower housing section and defining an opening through which the object may pass;

d. a rear cap attachable to the lower housing section and defining an opening through which the object may pass; and e. a rear bushing comprising:

i. a flanged base positionable within the rear cap; and ii. a tubular section attached to the flanged base and extendable through the rear cap opening.

2. A device according to claim 1 further comprising a container attachable to the lower housing section for receiving an electrical load.

3. A device according to claim 1 in which the front and rear bushings are made of neoprene rubber, for insulating the object from its surrounding environment.

4. A device according to claim 2 in which the container comprises a globe for at least partially insulating the received electrical load from the environment surrounding the container and forms a watertight seal when attached to the lower housing section.

5. A device for securing the position of an elongated object comprising:

a. a lower housing section defining first and second cavities for receiving portions of the object and comprising a first protrusion separating the first and second cavities, which first protrusion is positionable to contact the object at a first point;

b. an upper housing section fastenable to the lower housing section and comprising second and third protrusions, which second and third protrusions are alignable with the first and second cavities, respectively, and are positionable to contact the object at points remote from the first point along the length of the object;

c. a neoprene rubber front bushing positionable at least partially within the lower housing section and defining an opening through which the object may pass;

d. a rear cap attachable to the lower housing section and defining an opening through which the object may pass;

e. a neoprene rubber rear bushing comprising:

i. a flanged base positionable within the rear cap; and ii. a tubular section attached to the flanged base and extendable through the rear cap opening; and f. a container attachable to and forming a watertight seal with the lower housing section, which container comprises a globe for receiving and at least partially insulating an electrical load from the environment surrounding the container.

6. A device for securing the position of an elongated, electrically insulated object comprising:

a. a lower housing section comprising:

i. first and second cavities for receiving portions of the object;

ii. a first protrusion separating the first and second cavities, which first protrusion is positionable to contact the object at a first point; and iii. two ends, each of which ends has an associated, substantially circular opening for allowing the object to pass through the device; and b. an upper housing section fastenable to the lower housing section and comprising second and third protrusions, which second and third protrusions are alignable with the first and second cavities, respectively, and are positionable to contact the object at points remote from the first point along the length of the object.

7. A device according to claim 6 in which at least one end of the lower housing section is threaded for connecting the device to a housing for an electrical load.

8. A device according to claim 6 further comprising a rear cap attachable to the lower housing section and defining an opening through which the object may pass.

9. A device according to claim 8 further comprising a rear bushing extendable through the rear cap opening.

10. A device according to claim 9 further comprising a front bushing positionable at least partially within the lower housing section and defining an opening through which the object may pass.

* * * * *